US010082152B2

(12) United States Patent
Zhang et al.

(10) Patent No.: US 10,082,152 B2
(45) **Date of Patent: *Sep. 25, 2018**

(54) GAS TURBINE COMPRESSOR WITH ADAPTIVE BLADE TIP SEAL ASSEMBLY

(71) Applicant: Siemens Aktiengesellschaft, München (DE)

(72) Inventors: Jiping Zhang, Winter Springs, FL (US); Barton M. Pepperman, Winter Springs, FL (US)

(73) Assignee: SIEMENS AKTIENGSELLSCHAFT, München (DE)

( * ) Notice: Subject to any disclaimer, the term of this patent is extended or adjusted under 35 U.S.C. 154(b) by 323 days.

This patent is subject to a terminal disclaimer.

(21) Appl. No.: 14/870,838

(22) Filed: Sep. 30, 2015

(65) Prior Publication Data

US 2017/0089352 A1 Mar. 30, 2017

(51) Int. Cl.
*F01D 11/18* (2006.01)
*F01D 25/24* (2006.01)
(Continued)

(52) U.S. Cl.
CPC ..... *F04D 29/164* (2013.01); *F01D 11/18* (2013.01); *F01D 25/246* (2013.01);
(Continued)

(58) Field of Classification Search
CPC ..... F01D 11/18; F05B 2260/502; F05B 2280/1071; F05B 2280/50032; F05D 2260/38
See application file for complete search history.

(56) References Cited

U.S. PATENT DOCUMENTS 3,346,175 A * 10/1967 Wiles ..... C08G 59/22 415/136
6,733,233 B2 * 5/2004 Jasklowski ..... F01D 11/025 415/135

(Continued)

FOREIGN PATENT DOCUMENTS

EP 1944474 A2 7/2008
WO 2015038341 A1 3/2015

(Continued)

OTHER PUBLICATIONS

PCT International Search Report and Written Opinion of International Searching Authority dated Dec. 7, 2016 corresponding to PCT International Application No. PCT/US2016/053877 filed Sep. 27, 2016.

*Primary Examiner* — Dwayne J White
*Assistant Examiner* — Jason Davis

(57) ABSTRACT

A high-efficiency compressor section (10) for a gas turbine engine is disclosed. The compressor section includes a vane carrier (12) adapted to hold ring segment assemblies (16) that provide optimized blade tip gaps (28,29) during a variety of operating conditions. The ring segment assemblies include backing elements (30) and tip-facing elements (32) urged into a preferred orientation by biasing elements (40) that maintain contact along engagement surfaces (44, 46). The backing and tip-facing elements have thermal properties sufficiently different to allow relative growth that strategically forms an interface gap (42) therebetween, resulting in blade tip gaps that are dynamically adjusted operation.

4 Claims, 4 Drawing Sheets

(51) Int. Cl.

| | |
|---|---|
| ***F04D 29/54*** | (2006.01) |
| ***F04D 29/16*** | (2006.01) |
| ***F04D 29/52*** | (2006.01) |

(52) U.S. Cl.

CPC ..... *F04D 29/526* (2013.01); *F04D 29/541* (2013.01); *F05B 2220/302* (2013.01); *F05B 2260/502* (2013.01); *F05B 2280/1071* (2013.01); *F05B 2280/50032* (2013.01); *F05D 2240/11* (2013.01); *F05D 2260/38* (2013.01); *F05D 2300/171* (2013.01); *F05D 2300/5024* (2013.01)

(56) References Cited

U.S. PATENT DOCUMENTS

| | | | | |
|---|---|---|---|---|
| 2003/0202876 | A1 | 10/2003 | Jasklowski et al. | |
| 2006/0067815 | A1 | 3/2006 | Ghasripoor et al. | |
| 2010/0239415 | A1 | 9/2010 | Turnquist et al. | |
| 2012/0224958 | A1* | 9/2012 | Reed | F01D 21/045 415/213.1 |
| 2013/0101391 | A1* | 4/2013 | Szwedowicz | F01D 11/00 415/12 |
| 2014/0271147 | A1 | 9/2014 | Uskert et al. | |

FOREIGN PATENT DOCUMENTS

| | | | |
|---|---|---|---|
| WO | 2015112354 | A1 | 7/2015 |
| WO | 2015138027 | A2 | 9/2015 |

* cited by examiner

GAS TURBINE COMPRESSOR WITH ADAPTIVE BLADE TIP SEAL ASSEMBLY

FIELD OF THE INVENTION

This invention relates to an apparatus for optimizing the performance of gas turbine compressors. In particular, the invention relates to improving compressor efficiency via an adaptive blade tip seal assembly to adjust a gap between a turbine ring segment and an associated blade tip during engine operation.

BACKGROUND OF THE INVENTION

In gas turbine engines, multi-stage axial compressors include sets of alternating fixed vanes and rotating blades that, during operation, cooperatively produce a flow of compressed air for downstream use as a component of combustion.

As a byproduct of the compression process, components in the compressor are subjected to temperatures which vary not only in location, but also temporally, as the gas turbine progresses through a variety of operating modes, including cold start, steady state, and any number of transition conditions. Over time, these temperature differences impart varying degrees of thermal growth to the compressor components, and gaps required to allow relative motion during operation are designed to avoid unnecessary component rubbing, while minimizing leakage.

Gas turbines used for power generation may encounter particularly-difficult operating conditions, since they are often stopped and restarted in response to varying demands for power production. Engine operation in these settings may require that an engine be restarted before compressor components have uniformly cooled—known as a "hot restart." Compressors that passively accommodate hot restarts are often designed to strike a balance between either (1) using component gaps that, particularly between rotating blade tips and associated ring segments, bigger than needed during most steady-state conditions or (2) using relatively-small gaps and abradable coatings that are sacrificially worn down during component contact. Neither of these approaches is optimal; accordingly, there exists and a need in this field for an improved compressor design capable of accommodate hot restarts without unnecessarily reducing operational efficiency.

SUMMARY OF THE INVENTION

A gas turbine engine having a compressor section optimized to provide enhanced efficiency during several operating conditions, said compressor section comprising:

a vane carrier;

a ring segment assembly disposed within said vane carrier, said ring segment assembly characterized by a radially-outward backing element, a radially-inward tip-facing element, and at last one biasing element adapted and arranged to dynamically position said tip-facing element with respect to said backing element;

wherein said backing element is characterized by a first coefficient of thermal expansion and said tip-facing element is characterized by a second coefficient of thermal expansion, said first coefficient of thermal expansion being higher than said second coefficient of thermal expansion;

wherein said backing element includes a first mating surface and said tip-facing element includes a second mating surface, said mating surfaces adapted and arranged to provide positive engagement of said engage said first engagement notch;

wherein said at least one biasing element is positioned and adapted to cooperatively urge said tip-facing element against said backing element whereby said tip-facing element and said backing element, are alternately in contact along an interface disposed therebetween during a first operating condition and spaced apart along an interface an interface gap disposed therebetween during a second operating condition, and whereby said at least biasing element maintains contact between said first and second mating surfaces during both operating conditions.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

BRIEF DESCRIPTION OF THE DRAWING

The invention is explained in the following description in view of the drawings that show.

DETAILED DESCRIPTION OF THE INVENTION

Figure 1:
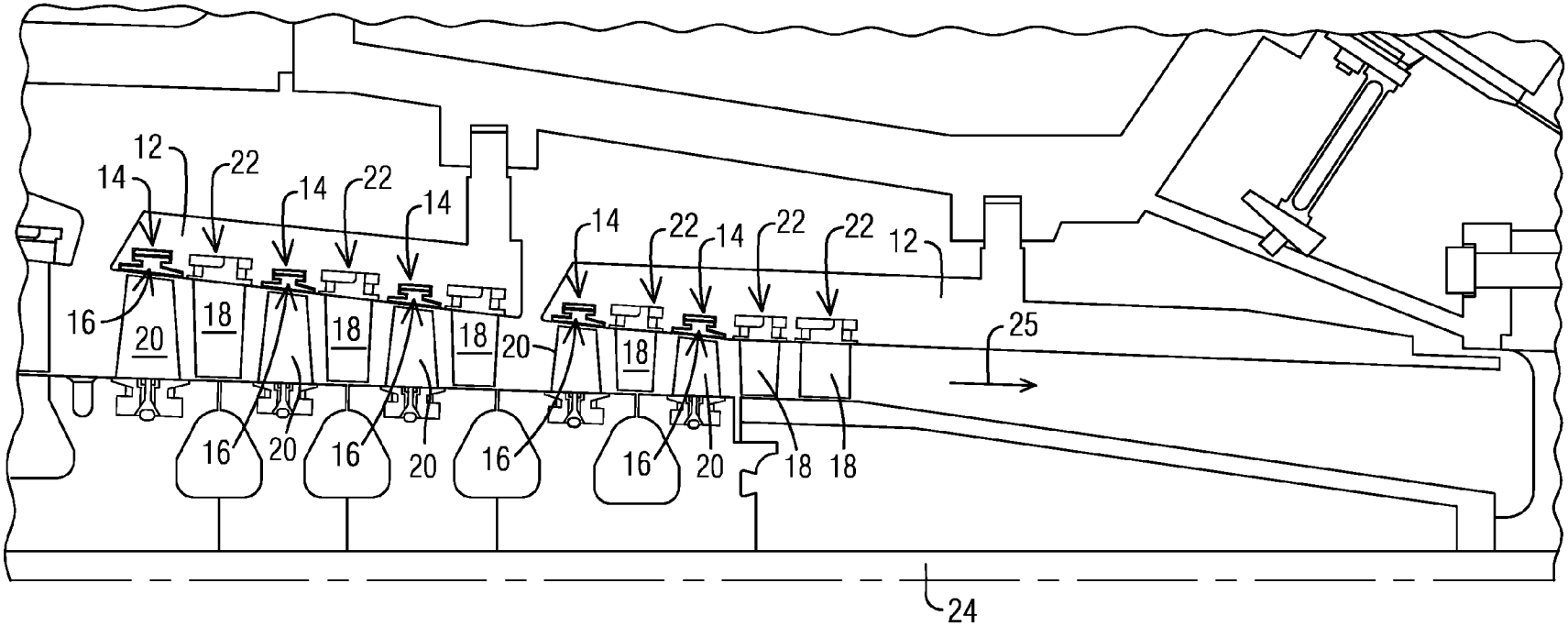
FIG. 1 is a side elevation of a gas turbine engine compressor section employing the ring segment assembly of the present invention.
Figure 4:
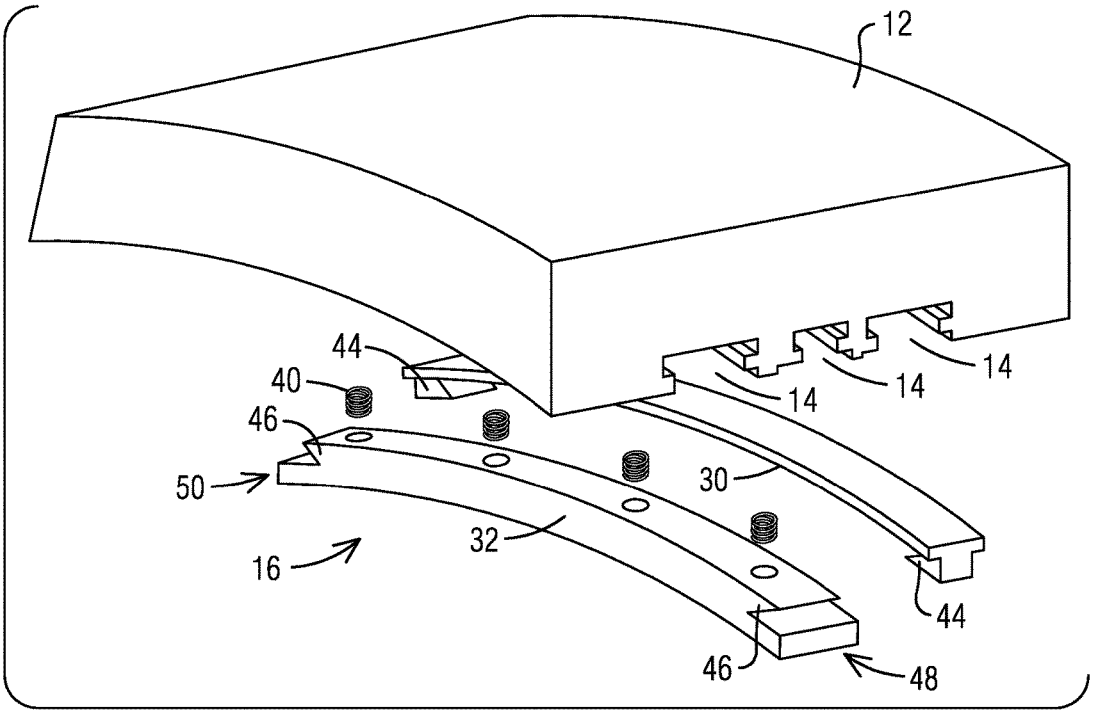
FIG. 4 is an assembly view of a ring segment assembly and vane carrier of the present invention.

Reference is now made in general to the Figures, and to FIG. 1, in particular, wherein the compressor section 10 of the present invention is shown. The compressor section 10 includes several stages of fixed vanes 18 and rotating blades 20—the vanes 18 are fixed within vane mounting slots 22 in vane carriers 12, and blades 20 are fixed within a longitudinally-aligned rotor 24 that spins about a central axis during operation. In a longitudinal, flow wise direction, the vane carriers 12 typically span several stages. As shown in FIG. 4, each is vane carrier has generally arcuate cross section when cut in a plane perpendicular to the center axis of the compressor rotor 24, and several are distributed circumferentially around the rotor 24 to form a bounded flow path 25 for compressed air to follow during operation. Although only one blade 20 and vane 18 is shown per stage, each stage will contain multiple blades and vanes distributed circumferentially within the bounded flow path 25.

Ring segment assemblies 16 are also mounted within the vane carriers 12. As shown more fully in FIGS. 2 and 3, the ring segment assemblies 16 are multi-layered and include a radially-outward backing element or plate 30 and a radially-inward tip-facing element 32 positioned proximate the tips 26 of the rotating blades 20 during operation. An optional abradable coating layer 34 may be positioned radially inward of the tip-facing element 32 to accommodate occasional blade tip contact. With continued reference to FIGS. 2 and 3, the radial space between the ring segment assemblies 16 and blade tips 26 defines a performance-impacting blade tip gap 28. As will be described more fully below, optimizing the size of these blade tip gaps 28 during the several engine operation modes improves engine overall efficiency and is an object of this invention.

Figure 2:
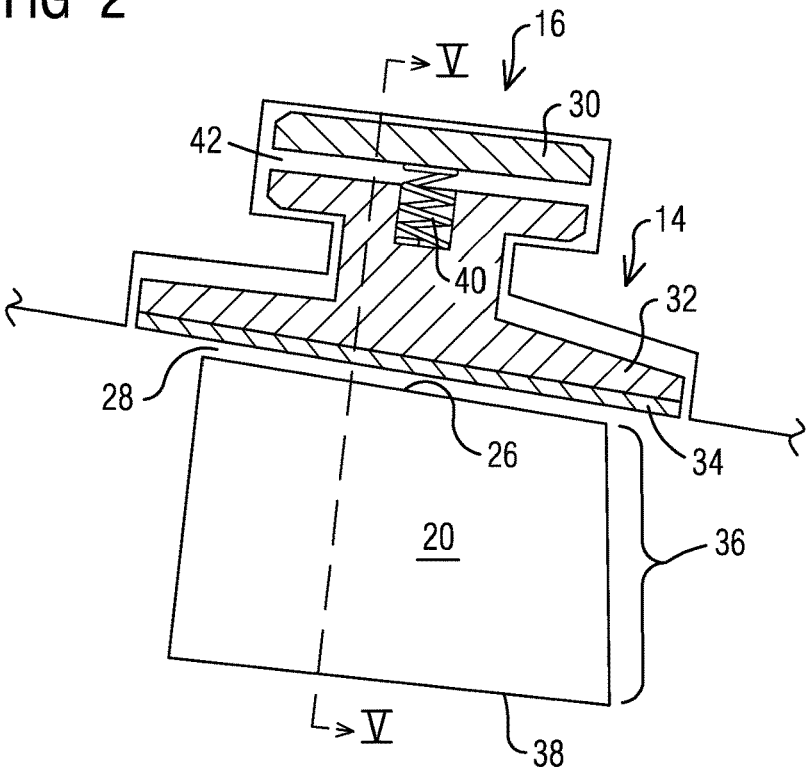
FIG. 2 is a side sectional view of a blade tip, ring segment assembly, and blade tip gap of the present invention during a steady-state operating mode.

In FIG. 2, a blade tip 26 is shown proximate a ring segment assembly 16 in a steady-state operating condition. In this condition, compressor components are generally considered to be thermally saturated, with the compressor components having reached an optimized level of thermally-driven component growth. In this steady state condition, a desired tip gap 28 exists between the ring segment assembly 16 and the various blade tips 26 of the blades 20 mounted on the circumferentially spinning rotor 24.

Figure 3:
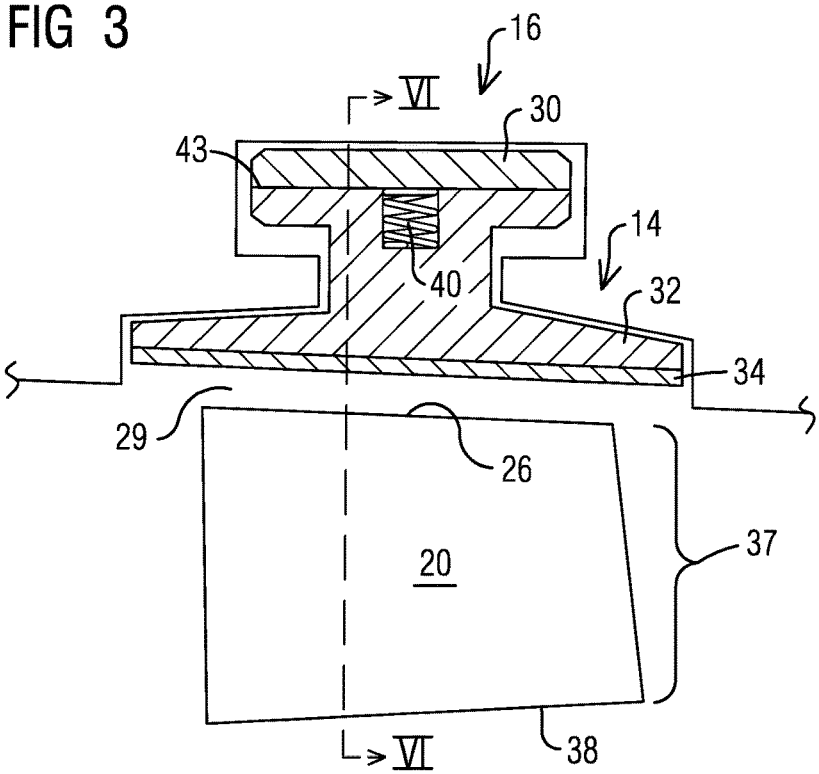
FIG. 3 is a side sectional view of a blade tip, ring segment assembly, and blade tip gap of the present invention during a hot restart operating mode.

In FIG. 3, the blade tip 26 is shown proximate a ring segment assembly 16 in a hot restart operating condition. In this condition, compressor components are no longer considered to be thermally saturated: due to variations in thermal growth tendencies, some components (like the ring segment assemblies 16) will have partially cooled and shrunk radially inward, while other components (like the rotating blades 20), will likely not have cooled. In this condition, a hot restart blade tip gap 29 exists, but it is typically larger than the steady-state blade tip gap 28.

Figure 5:
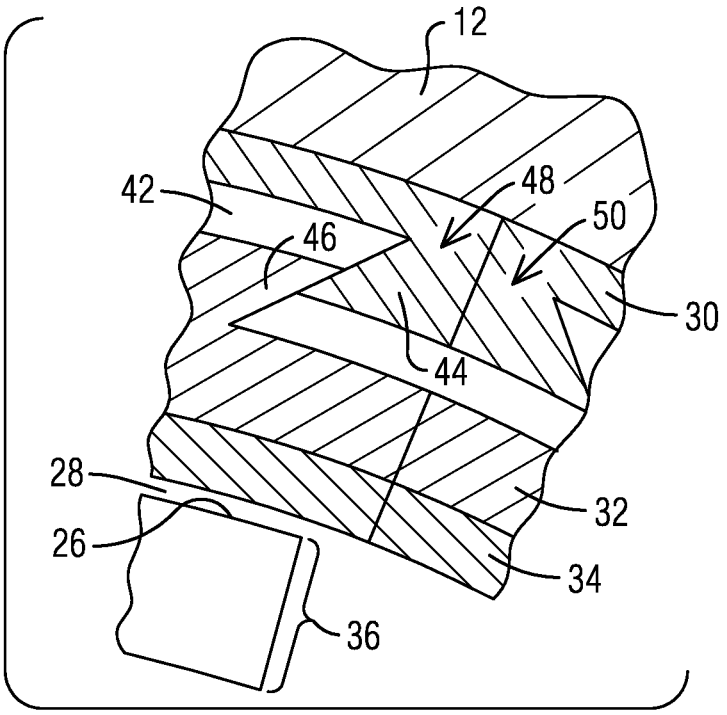
FIG. 5 is a partial side sectional view of ring segment assembly of the present invention, taken along cutting line V-V' during a steady-state operating mode.
Figure 6:
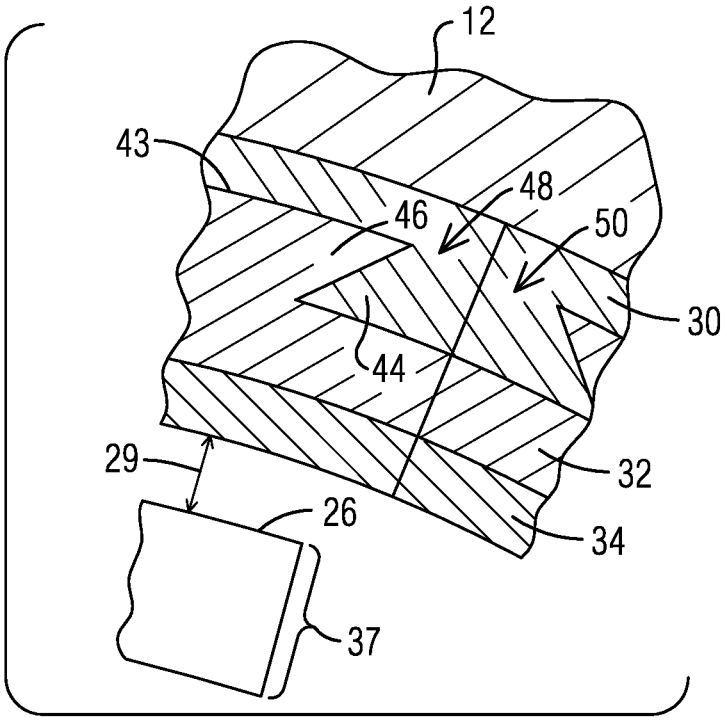
FIG. 6 is a partial side sectional view of ring segment assembly of the present invention, taken along cutting line VI-VI' during a hot restart operating mode.

In one embodiment of this invention, the backing element 30 and tip-facing element 32 are adapted and arranged to passively optimize the tip gaps 28, 29 present during steady-state (shown in FIG. 5) and hot restart conditions (shown in FIG. 6). In a preferred embodiment, the backing element 30 is more thermally reactive than the tip-facing element 32. In one arrangement, the backing element is made from a high alpha material (such as 304 stainless steel or thermal equivalent), while the tip-facing element is made from a low alpha material (such as 410 stainless steel or thermal equivalent). Additionally, with collective reference to FIGS. 4, 5, and 6, each backing element 30 and tip-facing element 32 respectively include positioning notches 44, 46 that, together with biasing elements 40, urge the backing and tip-facing elements into a tip-gap optimizing arrangement during the various operating conditions, as described more fully below.

During operation, the backing element 30 adopts several orientations due to differing thermal loads. For example the backing element shifts from a circumferentially-expanded and radially-compact orientation in the steady state condition shown in FIG. 5, to a circumferentially compact and radially expanded orientation in the hot restart condition shown in FIG. 6.

During steady state operating conditions, the backing elements 30 and tip-facing element 32 are spaced apart by an interface gap 42, and the associated positioning notches 44,46 cooperate with the biasing elements 40 shown in FIG. 2 to urge the backing elements and tip-facing element into positive engagement. This positive engagement creates and maintains a desired steady-state tip gap 28 that is large enough to avoid component damaging contact while small enough to provide efficient compressed airflow.

During hot restart conditions, the backing elements 30 and tip-facing element 32 have an interface 43, and the associated positioning notches 44,46 cooperatively urge the backing elements and tip-facing element into positive engagement. This positive engagement creates and maintains a desired hot restart tip gap 29 that is large enough to avoid component damaging contact while small enough to provide efficient compressed air flow.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope if the invention is defined by the claims appended hereto.

What is claimed is:

1. A gas turbine engine having a compressor section optimized to provide enhanced efficiency during several operating conditions, said compressor section comprising:

a vane carrier;

a ring segment assembly disposed within said vane carrier, said ring segment assembly characterized by a radially-outward backing element, a radially-inward tip-facing element, and at last one biasing element adapted and arranged to dynamically position said tip-facing element with respect to said backing element;

wherein said backing element is characterized by a first coefficient of thermal expansion and said tip-facing element is characterized by a second coefficient of thermal expansion, said first coefficient of thermal expansion being higher than said second coefficient of thermal expansion;

wherein said backing element includes a first mating surface and said tip-facing element includes a second mating surface, said mating surfaces adapted and arranged to provide positive engagement with each other;

wherein said at least one biasing element is positioned and adapted to urge said tip-facing element against said backing element; and whereby said tip-facing element and said backing element are alternately in contact along an interface disposed therebetween during a first operating condition and spaced apart along an interface gap disposed therebetween during a second operating condition, and whereby said at least one biasing element maintains contact between said first and second mating surfaces during both operating conditions.

2. The gas turbine engine having the compressor section of claim 1, wherein said backing element is made from high alpha stainless steel.

3. The gas turbine engine having the compressor section of claim 2, wherein said tip-facing element is made from low alpha stainless steel.

4. The gas turbine engine having the compressor section of claim 1 wherein said second operating condition is steady state operation characterized by temperatures sufficient to cause said interface gap.

* * * * *